US006879221B2

(12) United States Patent
Beis et al.

(10) Patent No.: US 6,879,221 B2
(45) Date of Patent: Apr. 12, 2005

(54) WAVEGUIDE TWIST

(75) Inventors: Konstantin Beis, Backnang (DE); Uwe Rosenberg, Backnang (DE)

(73) Assignee: Marconi Communications GmbH, Backnang (DE)

( * ) Notice: Subject to any disclaimer, the term of this patent is extended or adjusted under 35 U.S.C. 154(b) by 19 days.

(21) Appl. No.: 10/246,046

(22) Filed: Sep. 18, 2002

(65) Prior Publication Data

US 2003/0067364 A1 Apr. 10, 2003

(30) Foreign Application Priority Data

Sep. 19, 2001 (EP) ..... 01122376

(51) Int. Cl.[7] ..... H01P 1/161
(52) U.S. Cl. ..... 333/21 A; 333/24 R; 333/251
(58) Field of Search ..... 333/21 A, 21 R, 333/24 R, 24.3, 208, 251, 135

(56) References Cited

U.S. PATENT DOCUMENTS 2,668,191 A * 2/1954 Cohn ..... 333/21 A
2,754,483 A 7/1956 Zaleski
2,975,383 A * 3/1961 Seling ..... 333/21 A
5,380,386 A 1/1995 Oldham et al.

OTHER PUBLICATIONS

*IEEE MTT–S Digest*, Field Theory CAD of L–Shpaed Iris Coupled Mode Launchers and Dual–Mode Filters, Y–7, R. Ihmels, et al., pp. 765–768, 1993.

* cited by examiner

*Primary Examiner*—Robert Pascal
*Assistant Examiner*—Kimberly Glenn
(74) *Attorney, Agent, or Firm*—Kirschstein, et al.

(57) ABSTRACT

In a waveguide twist which provides orthogonal rotation of both direction and polarization, $TE_{10}$—mode energy in waveguide W1 is coupled via iris I1 to a transformer cavity capable of exciting both $TE_{10}$ and $TE_{01}$ modes. The $TE_{01}$ mode is coupled via iris I2 to output waveguide W2. Transformers may be interposed between one or both waveguides and their associated irises to increase bandwidth. The configuration facilitates manufacture in two halves by simple machining or casting.

12 Claims, 5 Drawing Sheets

WAVEGUIDE TWIST

This invention relates to transition between two orthogonally arranged rectangular waveguide ports. It particularly relates to such a transition where the orientation of the waveguide sections are also orthogonal. Such a transition can be particularly useful in integrated waveguide subsystems.

So-called waveguide twists are known which allow a coupling between waveguides having different angular orientations. One such type using step twist sections is discussed in "Step-Twist Waveguide Components"—Wheeler H A, IRE Trans. Microwave Theory Tech. Vol. MTT-S pp. 44–52 October 1955. Such transitions utilise series-connected intermediate sections of a rectangular waveguide arranged at progressively greater angles of inclination, Such arrangements are expensive to manufacture and are only suitable for coupling wav-guides whose axes are coincident. Another waveguide twist for coupling between waveguides when axes are parallel but not coincident is disclosed in German published patent DE 3824150 C2.

The invention provides a waveguide twist providing orthogonal rotation of both direction and polarisation, comprising: a transformer section having a generally square cross-section and having a first transformer end face and a side face; a first rectangular waveguide arranged to propagate microwave energy having a first polarisation and whose axis is arranged orthogonal to the first transformer end face with its short side parallel to the side face, the waveguide terminating in a first waveguide end face, a first iris defined between the first waveguide end face and the first transformer end face; a second rectangular waveguide having a rectangular cross-section orthogonal to the cross-section of the first waveguide and a second waveguide end face and arranged with its longitudinal axis orthogonal to the first transformer side face with a long side parallel to the first transformer end face so as to propagate microwave energy having a polarisation plane orthogonal to the polarisation plane of energy in the first waveguide, and a second iris defined between the second waveguide end face and the transformer side face.

Embodiments of the invention will now be described by way of non-limiting example only, with reference to the accompanying drawings in which:

FIG. 1 shows an isometric view of the internal walls of a twist transformation structure which can be fabricated in solid metal. The exterior of the structure and coupling flanges etc. have been omitted for clarity.

Figure 1:
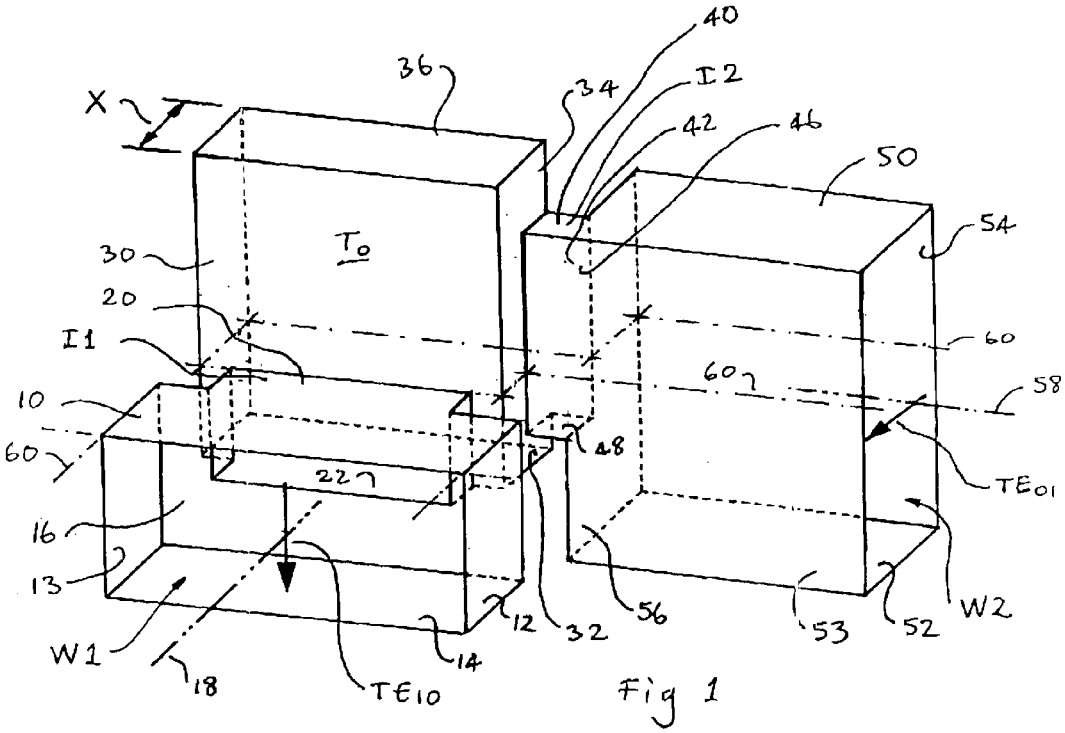
FIG. 1 shows a first embodiment of the invention.

A first port consists of a standard rectangular waveguide section W1 having long sidewalls 10,14 and short sidewalls 12,13. Waveguide W1 is coupled via a first iris I1 to a front side wall 30 of a central dual-mode transformer section $T_o$. In this embodiment an upper surface 20 of iris I1 forms a continuation of the upper surface of the long sidewall 10 of waveguide W1. The lower surface 22 of iris I1 forms a continuation of the lower surface 32 of the transformer $T_o$. A second port consisting of a second standard rectangular waveguide section W2 having lond sidewalls 50,52 and short sidewalls 53,54 is coupled via a second iris I2 to a side wall 34 of transformer section To. In this embodiment a first lateral surface 42 of iris I2 forms a continuation of sidewall 53 of waveguide W2. A second lateral surface 46 of iris I2 forms a continuation of a rear surface 36 of the is transformer section $T_o$.

Viewed from the first waveguide section W1, the transformer section $T_o$ has an almost square cross-sectional area and a length X measured in the direction of the axis of W1 of about a quarter wavelength of the centre frequency of the bandwidth of intended operation. The square configuration means that the central transformer section $T_o$ is capable of supporting both $TE_{10}$ and $TE_{01}$ modes.

Figure 2:
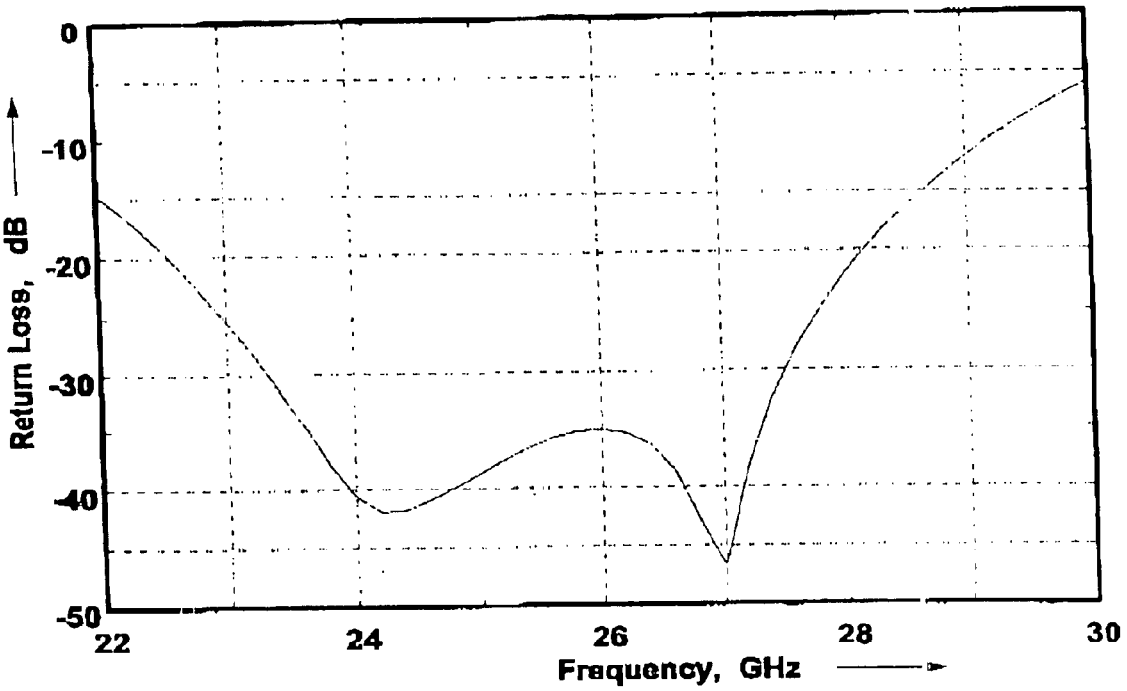
FIG. 2 shows a graph of the computed return loss as a function of a frequency of the first embodiment.

In operation, a $TE_{10}$ microwave signal propagated in W1 passes through the first iris I1 and into the transformer section $T_o$ where it excites $TE_{10}$ and $TE_{01}$ modes. The $TE_{01}$ mode within the transformer $T_o$ couples via the second iris I2 into the second waveguide W2 where it excites a $TE_{01}$ mode (referenced to co-ordinate system of W1). It can be seen that, with reference to the vertical axis, waveguide W2 is rotated 90° with respect to waveguide W1 and hence, with respect to the vertical axis, the polarisation direction of microwave energy in W2 is orthogonal to the polarisation direction of microwave energy in W1. As can be seen from FIG. 2, the two discontinuities presented by irises I1 and I2 result in a frequency characteristic having two return loss zeros. These two zeros assist in the attainment of a relatively wide useful bandwidth.

Figure 3:
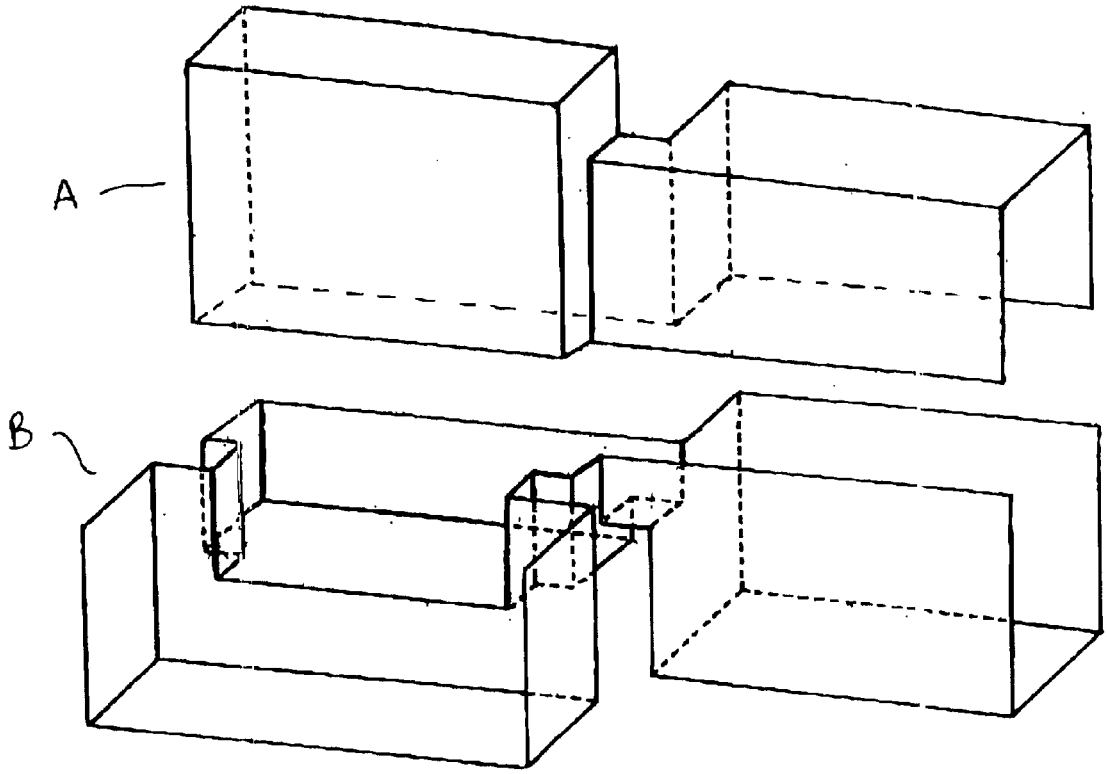
FIG. 3 shows the arrangement of FIG. 1 separated into two-part form along a possible plane of separation.

The configuration described above is particularly advantageous in that it allows manufacture in two halves which are mated together at a planar mating surface. In FIG. 1 the location of a particularly advantageous surface is shown by chained dashed lines 60. FIG. 3 shows the arrangement of FIG. 1 separated into an upper part A and a lower part B by the plane defined by chained dashed lines 60 of FIG. 1. It can be seen that all surfaces of upper part A are visible from below and all surfaces of lower part B are visible from above. The skilled person will appreciate that each half can therefore be easily and economically manufactured by casting or milling, since neither includes any undercut or hidden regions.

Figure 4:
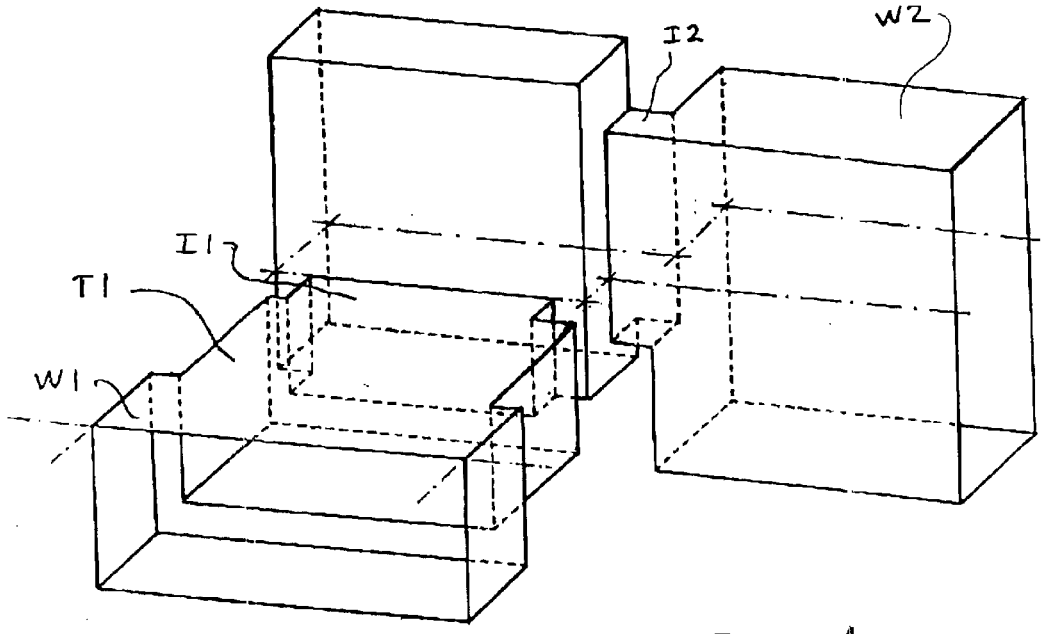
FIG. 4 shows a second embodiment to the invention.

A second embodiment, shown in FIG. 4, differs from the first embodiment in that it includes a quarter wavelength transformer T1 in series with the first waveguide W1 and of the first iris I1, Transformer T1 provides an additional zero in the frequency response which allows a greater band width (about 20%) to be achieved compared with the first embodiment. Transformer T1 is preferably arranged with its upper face in the same plane as the upper faces of the waveguide W1 and the first iris I1. This facilitates manufacturing in two halves defined by the chained dashed lines as in the first embodiment.

In a modification of FIG. 4, not shown, a second transformer may be arranged in series between the second iris I2 and at the second waveguide W2 in addition to, or in place of, the first transformer. The provision of a second transformer in addition to the first transformer providers a further zero, allowing an even wider band width to be obtained.

Figure 5:
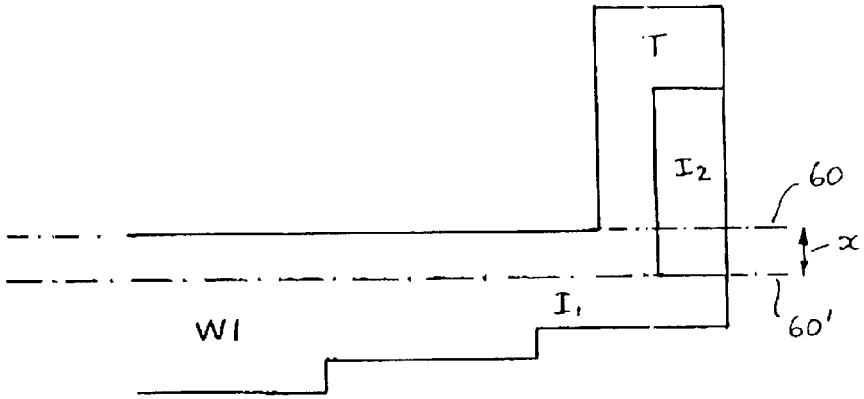
FIG. 5 illustrates a range of possible planes of separation for FIGS. 1 and 4.

While the parting lines 60 between upper and lower halves have been described as coincident with the upper surface of waveguide W1, this is not essential. As can be seen from FIG. 5 by choosing a parting line anywhere in zone x defined between planes 60 and 60' neither half will have any hidden or overhanging areas. However, for ease of manufacture, a parting line on plane 60 is preferred. A plane other than 60 may be useful if it is desired to provide a transformer or iris whose upper surface is not coincident with the upper surface of waveguide W1, for example, so as to accommodate the relative spatial axes of waveguides W1 and W2 with other waveguides whose spatial positions are predetermined. The design freedom provided by offsetting the irises and transformers is particularly advantageous in integrated waveguide assemblies where prior art twist are unsuitable due to lack of space or high manufacturing cost. Rather than other components having to be designed to mate with the waveguide twist, the waveguide twist can be designed to mate with the other components.

Thus, while FIG. 1 shows the upper short edge of iris I2 coplanar with the upper surface 50 of the second waveguide W2, it would be possible to vertically and/or laterally offset the second waveguide W2 so that the second iris I2 were located at a different part of end surface 56.

Conversely, where a twist is to be used in a location where there is some freedom in the positioning of waveguides W1 and W2, it is possible to utilise an arrangement in which all the complex machining or casting is carried out on only one of the two parts, the mating surface of the other part consisting of a planar surface.

Figure 6:
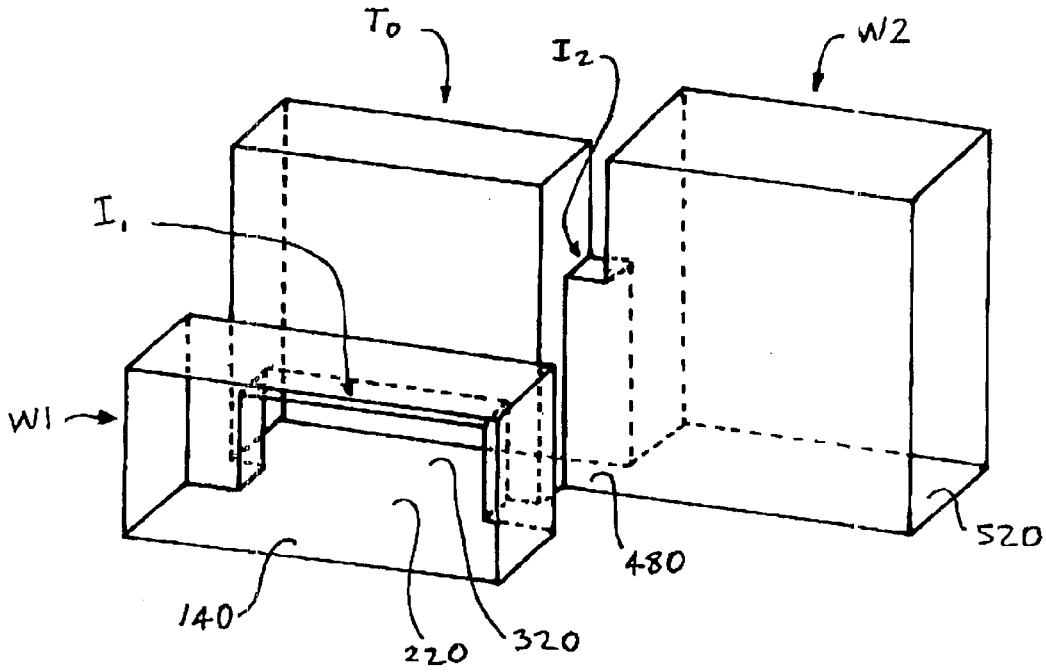
FIG. 6 shows a third embodiment of the invention.

An example of such an arrangement is shown in FIG. 6, where lower surface 140 of the first waveguide W1, 220 of the first iris I1, 320 of the transformer section To, 480 of second iris I2, and 520 of second waveguide W2, all lie in the same plane. It can be seen that, when manufactured in two parts, the upper part can be manufactured by simple machining, since all parts are visible from below, and the lower part is a simple planar surface. N this embodiment, while the axes of the waveguides W1, W2 are fixed in a vertical sense, a certain amount of choice of lateral position of both W1 and W2 is possible.

What is claimed is:

1. A wave guide twist providing orthogonal rotation of both direction and polarization, comprising:

a) a transformer section having a first transformer end face and a first transformer side face lying in mutually orthogonal planes;

b) a first rectangular waveguide for propagating microwave energy having a first polarization, the first waveguide having a first rectangular cross-section and an axis arranged orthogonal to the first transformer end face, and a short side parallel to the first transformer side face, the first waveguide terminating in a first waveguide end face;

c) a first iris located between the first waveguide end face and the first transformer end face, the first iris having a first iris cross-section smaller than the first rectangular cross-section of the first waveguide;

d) a second rectangular waveguide having a second rectangular cross-section orthogonal to the first rectangular cross-section of the first waveguide, and a second waveguide end face, the second waveguide having a longitudinal axis arranged orthogonal to the first transformer side face, and a long side parallel to the first transformer end face so as to propagate microwave energy having a polarization orthogonal to the first polarization in the first waveguide; and e) a second iris located between the second waveguide end face and the first transformer side face, the second iris having a second iris cross-section smaller than the second rectangular cross-section of the second waveguide.

2. The waveguide twist as claimed in claim 1, in which the first iris is vertically offset towards a long side of the first waveguide and towards a bottom of a front face of the transformer section.

3. The waveguide twist as claimed in claim 2, in which the first iris has a long surface which is coincident with the long side of the first waveguide.

4. The waveguide twist as claimed in claim 2, in which the first iris has a lower surface which is coincident with a bottom face of the transformer section.

5. The waveguide twist as claimed in claim 1, in which the second iris is laterally offset towards the long side of the second waveguide.

6. The waveguide twist as claimed in claim 5, in which the second iris has a first surface which is coincident with the long side of the second waveguide.

7. The waveguide twist as claimed in claim 6, in which the second iris has a second surface which is coincident with a second end face of the transformer section.

8. The waveguide twist as claimed in claim 5, in which the second iris is vertically offset towards a short side of the second waveguide.

9. The waveguide twist as claimed in claim 8, in which the second iris has a short surface which is coincident with the short side of the second waveguide.

10. The waveguide twist as claimed in claim 1, further comprising a first transformer arranged between the first waveguide and the first iris.

11. The waveguide twist as claimed in claim 10, further comprising a second transformer arranged between the second waveguide and the second iris.

12. The waveguide twist as claimed in claim 1, in which a long side of the first waveguide, a long surface of the first iris, a bottom surface of the transformer section, and a short surface of the second waveguide lie in the same plane.

* * * * *